United States Patent [19]

Brach

[11] 4,126,240

[45] Nov. 21, 1978

[54] TAMPER INDICATING CLOSURE

[75] Inventor: Ulrich Brach, Zell (Mosel)., Fed. Rep. of Germany

[73] Assignee: Zeller Plastik, Zell, Mosel, Fed. Rep. of Germany

[21] Appl. No.: 704,340

[22] Filed: Jul. 12, 1976

[30] Foreign Application Priority Data

Jul. 10, 1975 [DE] Fed. Rep. of Germany ..... 2530699

[51] Int. Cl.[2] ..... B65D 41/34

[52] U.S. Cl. ..... 215/252; 215/360

[58] Field of Search ..... 215/252, 253, 249, 251, 215/364, 254, 256, 360; 220/276

[56] References Cited

U.S. PATENT DOCUMENTS

| | | | |
|---|---|---|---|
| 2,124,638 | 7/1938 | Sheldon | 215/252 |
| 3,025,988 | 3/1962 | Williams | 215/355 |
| 3,081,899 | 3/1963 | Parker | 220/276 |
| 3,170,603 | 2/1965 | Kitterman | 215/256 |
| 3,673,761 | 7/1972 | Leitz | 215/252 |
| 3,998,354 | 12/1976 | Song | 220/254 |

FOREIGN PATENT DOCUMENTS

| | | | |
|---|---|---|---|
| 1,347,224 | 11/1962 | France | 215/301 |
| 2,300,715 | 2/1975 | France | 215/252 |

*Primary Examiner*—Ro E. Hart
*Attorney, Agent, or Firm*—Martin P. Hoffman

[57] ABSTRACT

A unitary, integrally-formed, molded plastic closure used to seal containers having threaded necks and a radially extending collar situated therebelow. Closure includes internally threaded cap, plurality of tongues spaced about lower periphery of cap, frangible tamper indicating ring spaced axially below lower periphery of cap, and a plurality of thin webs interconnecting the ring and the tongue. Closure is advanced over the threaded neck on container by automated machinery so that ring abuts against collar on container. Indicating ring includes weakened area to allow limited radial expansion, and an inwardly extending radial flange may be defined at upper end of ring. Lugs are formed on periphery of tongues.

After ring abuts against collar, continued advancement of the closure along threaded neck (1) shears the webs and frees the tongues from the ring; (2) subsequently enables the tongues to engage and enter the ring in serial fashion, and (3) resiliently interlocks the ring and the tongues. The interlocked continuous ring and tongues connotate that the closure has been seated for the first time and that no attempt has been made to disturb the contents of the container.

Subsequently, when the closure is removed by advancing same over the neck of container in the direction opposite to the seating motion, the threads on container radially expand the tongues and interlocking ring, thus fracturing the tamper-indicating ring at weakened area. Ring falls free of the cap to reveal at least some of the tongues and serve as a visual indicator that closure has been opened at least one time.

10 Claims, 7 Drawing Figures

FIG. 1.
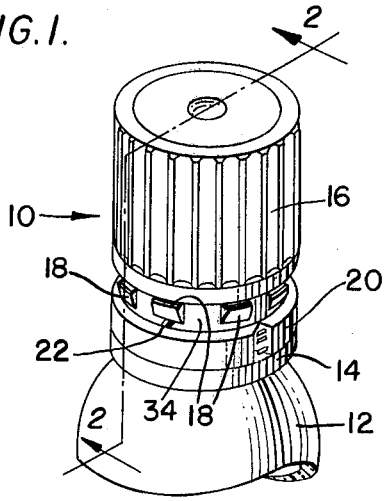
FIG. 4.
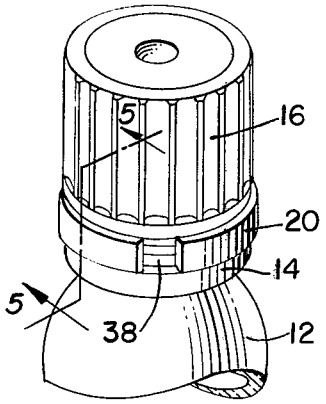
FIG. 2.
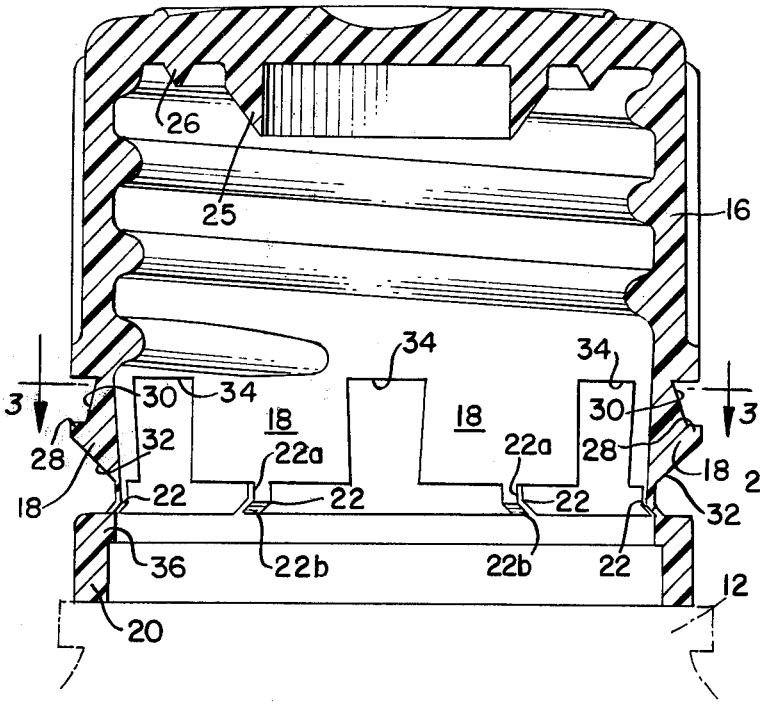
FIG. 5.
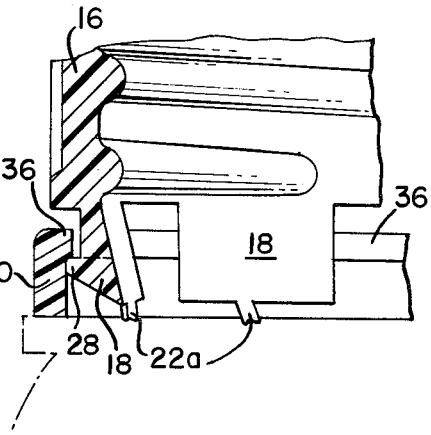
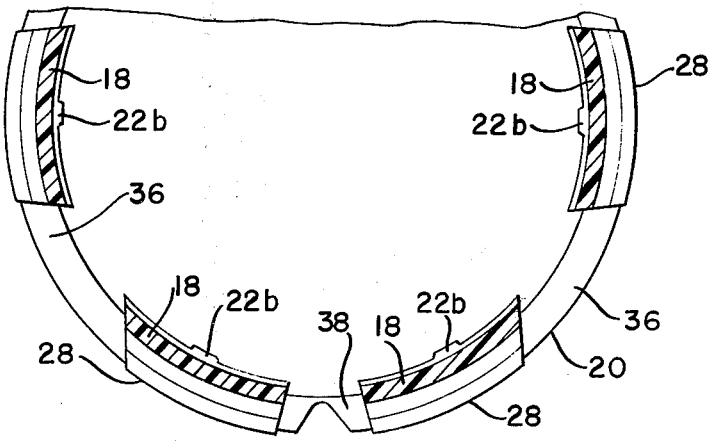
FIG. 3.

TAMPER INDICATING CLOSURE

BACKGROUND OF THE INVENTION

1. Field of the Invention

This invention relates generally to tamper indicating closures.

2. Description of the Prior Art

Tamper indicating closures including an integrally formed cap, a tamper indicating ring, and spaced thin webs, or bridges, for joining the cap to the ring are well known; see, for example, U.S. Pat. No. 3,463,341, granted Aug. 26, 1969 to M. R. Fields.

However, the Fields closure is applicable only to containers having radially projecting tongues molded or otherwise secured thereon; such tongues extend into the gaps between the adjacent webs. When one attempts to remove the closure from the container, the tongues shear the webs and separate the tamper-indicating ring from the cap. Continued rotation of the cap exposes the contents of the container, and the cap, minus the tamper-indication ring, may be re-used as an ordinary cap.

Some shortcomings of the Fields tamper-indicating closure are readily apparent. The webs must be molded within precise dimensional tolerances, for they must be sufficiently flexible in the axial direction for the closure to be assembled upon the container over the projecting tongues by high speed, automated machinery, and yet be strong enough in the radial direction to retain the cap on the tamper-indicating ring in fixed position. Also, the container would have to be formed of a readily moldable material, such as plastic, glass, or the like that would permit the formation of the radially projecting, resilient tongues.

Other plastic molded tamper-indicating closures have been developed, but such closures suffer from one or more of the shortcomings noted in the preceding paragraph.

SUMMARY

Thus, with the deficiencies of known tamper-indicating closures clearly in mind, the instant invention contemplates an inexpensive, effective, and readily molded unitary plastic closure that can be secured upon plastic and glass containers by high speed, automated machinery. Furthermore, the instant invention contemplates a plastic closure wherein the tamper-indicating ring, after severance from the cap, is entered in serial fashion by the tongues extending axially below the cap. The tongues momentarily force the ring outwardly until its natural resilience permits it to snap inwardly and engage its inwardly directed radially extending flange in an annular recess defined on the periphery of the tongues. The inwardly directed flange and the recess on the tongues enable the interlocking action of the ring and tongues. Consequently, when the cap is unscrewed from the container, the threads on the container exert a radial force on the tamper-indicating ring which expands the ring, thus fracturing same and causing it to fall free of the tongues. The exposure of the tongues thus serves as a visual indicator that the closure has been removed from the container, or at the very least, has been tampered with.

Rather than relying upon thin, axially extending webs and radially projecting tongues to locate the closure on the container, the instant invention employs an annular collar on the neck of the container to function as a stop for the positive seating of the closure upon the container. Additionally, the tongues and the webs are molded with several cooperating segments, and the tamper-indicating ring includes a top flange for cooperation with the various surfaces of the tongues to facilitate interlocking therewith and a weakened, frangible area so that the threads on the container may easily expand the ring until it breaks or fractures in a predetermined frangible area.

Yet other objectives and advantages achieved by the instant invention will become readily apparent from the following description when construed in harmony with the appended drawings.

BRIEF DESCRIPTION OF THE DRAWINGS

FIG. 1 is a perspective view of a tamper-indicating closure embodying the principles of the instant invention, such closure being in the process of being seated upon the neck of a container;

FIG. 2 is a vertical cross-sectional view through the closure, such view being taken along line 2—2 in FIG. 1 and in the direction indicated;

FIG. 3 is a horizontal cross-sectional view through the closure, such view being taken along line 3—3 in FIG. 2 and in the direction indicated;

FIG. 4 is a perspective view similar to the view of FIG. 1, such view, however, being taken after the closure is fully seated upon the neck of the container;

FIG. 5 is a vertical, fragmentary cross-sectional view of the closure, such view being taken along line 5—5 in FIG. 4 and in the direction indicated;

DESCRIPTION OF THE PREFERRED EMBODIMENTS

Figure 6:
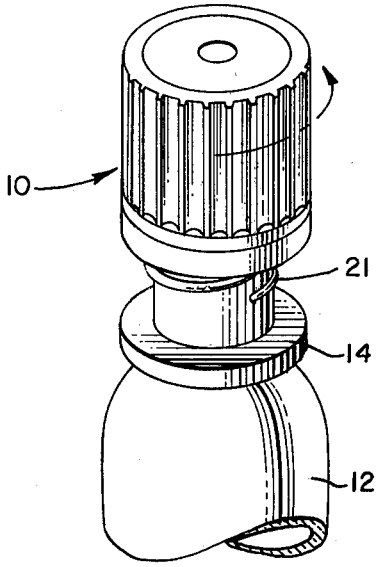
FIG. 6 is a perspective view taken during the opening movement of the closure.

Referring now to the drawings, FIG. 1 depicts a tamper-indicating closure 10 secured to the neck of a container 12 having an annular collar 14. The container may be formed from either glass or plastic. FIG. 1 illustrates the closure in the process of being assembled onto the container 12 to seal the contents thereof, and prior to the application of any rotational forces that would unseat the closure.

As best shown in FIGS. 2 and 3, closure 10 is a unitary, integrally molded, plastic assembly comprising a cylindrical end cap 16, a plurality of tongues 18, a tamper-indicating ring 20 and a plurality of webs 22 interconnecting the tongues to the tamper-indicating ring 20. The inner surface of cap 16 has threads 24 which cooperate with complementary threads 21 on the neck of the container 12. A stopper 25 and seal 26 on the interior surface of the end wall of cap 16 enhance the effectiveness of the closure, and eliminate the need for separate rubber gaskets or washers. The cap 16 has a fluted exterior surface so that the cap can easily be rotated relative to the container 12.

The tongues 18, which depend below the lower end of cap 16, can be flexed outwardly a short distance as the closure is positioned upon the container 12. Each tongue includes a central projecting lug 28, an upper outwardly tapering section 30 that extends between the cap 16 and the lug 28, and a lower, conical section 32 that extends between lug 28 and the web 22. The tongues are separated from each other by a gap 34. It is noted that the lower edge of the cap serves as a hinge line for the flexing movement of the tongues 18, and that the outer diameter of the oppositely disposed lugs exceeds the inner diameter of ring 20.

Webs 22 extend downwardly to interconnect tamper-indicating ring 20 to the lower edge of the tongues 18. The upper section 22*a* of each web extends axially downwardly in the plane of cap 16, while the lower section 22*b* of each web projects outwardly toward the tamper-indicating ring 20. Sections 22*a*, 22*b* of each web intersect at a pronounced angle. As the cap is completely screwed down on the container, the webs 22 are sheared and the tongues 18 slide into, or enter, the confines of the ring 20 in serial fashion.

The lower end of tamper-indicating ring 20 is securely seated upon the collar 14 of the container 12; and the collar serves as a stop to prevent the ring from moving axially downwardly on the container. An inwardly projecting flange 36 is located at the upper edge of ring 20, and the lower end 22*b* of each web 22 is joined thereto. Ring 20 also includes a frangible area 38 of reduced thickness; see FIG. 3.

FIG. 4 shows the closure 10 after the rotational forces for initially seating same have been applied thereto by automated machinery, or by manual operations. The internally threaded cap has moved downwardly along the threads on the neck of the container 12, until the ring 20 has been arrested by the collar 14 on the container. The webs 22 have been sheared by a continuation of the application of the rotational forces, and the ring 20 has been freed from the lower edges of the cap 16.

As the application of rotational forces to seat the cap 16 is continued, the outer surfaces of the conical sections 32 of the tongues 18 sequentially engage the flange 36 of the ring 20, and gradually expand same. The sequential engagement of the tongues is attributable to the movement of the cap along the spiral threads on the neck of the container 12.

The flange 36 of ring 20 is cammed, lifted, or otherwise forced over lugs 28 on each succeeding tongue 18 until the flange snaps into the annular recess defined between the lower periphery of cap 16 and the lug 28 on each tongue 18, as shown in FIG. 5. The ring 20 is thereby retained in such position on the cap 16 due to its inherent resiliency, as shown in FIGS. 4–5.

Figure 7:
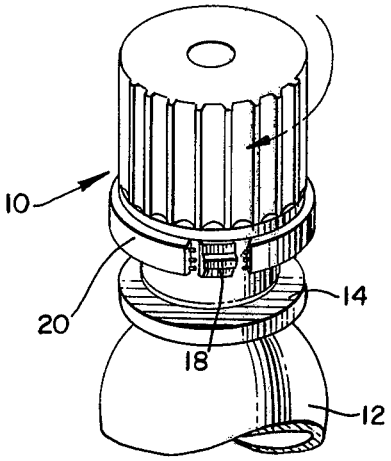
FIG. 7 is a perspective view similar to the view of FIG. 1, such view, however, being taken after the closure has been removed from the container at least once.

During the subsequent opening of the closure to reveal the contents of the container, the cap 16 is advanced along the threads of the container and such movement produces a radially directed force of sufficient magnitude to break the ring 20 at its weakened, frangible area 38. The interlock between the ring 20 and the recesses on the lugs 20 on the tongues 18 is destroyed, so that the ring 20 drops away from the tongues. At least some of the previously obscured tongues are thus exposed, and serve as a visual reminder that the closure has been subjected to at least one attempt to open same. The fracturing of the weakened area 38 of the ring is shown in FIG. 6, and the tongues are readily visible in FIG. 7.

In subsequent resealing operations, the cap 16 is advanced downwardly along the threads on the container 12 until the bottom edges of the tongues 18 contact the collar 14.

The closure cannot be removed from the container 12 prior to the severance of the webs 22, for ring 20 prevents closure removal by exerting an upwardly directed axial force or by an unscrewing action.

The above described preferred embodiment will suggest various modifications to the skilled artisan. For example, the flange 36 may be omitted from the tamper-indicating ring 20; and the resultant ring 20, when severed from the webs, may still be expanded sufficiently by the conical sections of the tongues 18 to snap into the annular recess situated above lugs 28. Furthermore, the number of tongues 18, and the size of the gaps 34 therebetween, can be varied; while the tongues 18 are best utilized in diametrically opposed pairs, an uneven number of tongues can be utilized. The paramount consideration is that the diametrical distance between the outer extremities of lugs 28 be greater than the inner diameter of ring 20. The collar 14 can also be a series of discontinuous spaced stops. Consequently, the appended claims should not be limited to their literal terms, but should be broadly construed in a manner commensurate with the advances in the useful arts and sciences set forth in this application.

What is claimed is:

1. In combination, a container and a resealable closure therefor, (a) said container having a threaded neck portion, (b) said closure comprising:

(1) a cylindrical cap with internal threads for engagement with, and movement along, the threads on the container, (2) a plurality of spaced tongues depending below the cap, (3) a tamper-indicating ring, (4) a plurality of thin webs connecting the tongues to the ring, (5) said cap, tongues, webs and ring being integrally formed as a unitary, resilient plastic molding, (c) said webs being sheared to separate the ring from the tongues as the cap is threaded onto the container, (d) said tongues entering and expanding the ring until the ring is interlocked with the tongues as the cap is threaded downwardly into sealing engagement with the container, (e) said interlocked ring and tongues being radially expanded by the threads on the neck of the container as the cap is unscrewed from its sealing engagement with the container, (f) said ring fracturing in response to the radial expansion thereof and falling free of said tongues to expose same and thereby provide a visual indication that an attempt has been made to gain access to the container.

2. The combination as defined in claim 1 wherein the inner surface of each tongue lies in the plane of the cap and the outer surface of each tongue includes an outwardly projecting lug.

3. The combination as defined in claim 2 wherein each tongue further includes an outwardly tapering section extending between the lower periphery of the cap and said lug, and a conical section extending between said lug and said webs.

4. The combination as defined in claim 1 wherein each tongue is able to flex outwardly a small distance to allow the closure to pass over the threads on the container.

5. The combination as defined in claim 1 wherein each web includes an upper section that lies in the plane of the cap, and a lower section that extends downwardly and outwardly to the tamper-indicating ring.

6. The combination as defined in claim 1 wherein said tamper-indicating ring has a frangible area that yields well within the resilient limits of said ring.

7. The combination as defined in claim 1 wherein said tamper-indicating ring has an inwardly projecting flange at its open end.

8. The combination as defined in claim 1 wherein a radially extending stop is formed on the container below the threaded neck portion, and said tamper-indicating ring abuts against said stop when the cap has been threaded downwardly into sealing engagement with the container.

9. The combination as defined in claim 8 wherein the radially extending stop on the container is a continuous annular collar.

10. A method of applying a tamper-indicating closure to a container to prevent undetected access to the contents of the container, said container having a threaded neck and a radially extending stop positioned therebelow, said closure comprising an internally threaded cap with tongues depending therebelow, a tamper-indicating ring, and thin webs joining the tongues to the ring, said cap, tongues, webs and ring being integrally formed as a resilient plastic molding, said method comprising the steps of:

(a) screwing the cap downwardly along the threads on the container until the webs are sheared and the ring is freed from the tongue but arrested by the stop, (b) continuing the screwing action so that the tongues enter the ring and expand same until the ring is locked onto the outer surfaces of the tongues on the cap, and (c) unscrewing the threaded cap from the container so that the interlocked ring and tongues pass over the thread neck, (d) the threads exerting a radial force on the ring and tongues of sufficient magnitude to fracture the ring and cause same to expose the underlying tongues, (e) the exposure of the tongues serving as a visual reminder that the cap has been unscrewed at least once to expose the contents of the container.

* * * * *